US008611789B2

(12) United States Patent
Gyoutoku

(10) Patent No.: US 8,611,789 B2
(45) Date of Patent: Dec. 17, 2013

(54) IMAGE FORMING APPARATUS INCLUDING DEMOUNTABLE DEVELOPING UNIT

(75) Inventor: Eiji Gyoutoku, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 204 days.

(21) Appl. No.: 13/210,870

(22) Filed: Aug. 16, 2011

(65) Prior Publication Data

US 2012/0051782 A1 Mar. 1, 2012

(30) Foreign Application Priority Data

Aug. 26, 2010 (JP) ..... 2010-190128

(51) Int. Cl.
*G03G 15/08* (2006.01)

(52) U.S. Cl.
USPC ..... 399/119

(58) Field of Classification Search
USPC ..... 399/11, 27, 29, 31, 43, 53, 81, 119
See application file for complete search history.

(56) References Cited

U.S. PATENT DOCUMENTS

| | | | | |
|---|---|---|---|---|
| 4,963,936 | A * | 10/1990 | Carter | 399/119 |
| 5,239,345 | A * | 8/1993 | Kikuchi et al. | 399/236 |
| 5,933,688 | A * | 8/1999 | Suzuki et al. | 399/222 |
| 7,274,885 | B2 * | 9/2007 | Yokogawa | 399/26 |

FOREIGN PATENT DOCUMENTS

| | | | |
|---|---|---|---|
| JP | 60021073 | A * | 2/1985 |
| JP | 1-172985 | | 7/1989 |
| JP | 2000-172142 | | 6/2000 |
| JP | 2003208024 | A * | 7/2003 |
| JP | 2004-219743 | | 8/2004 |
| JP | 2006047871 | A * | 2/2006 |
| JP | 2006-317841 | | 11/2006 |
| JP | 2007025976 | A * | 2/2007 |
| JP | 2009-258276 | | 11/2009 |
| JP | 2010-14991 | | 1/2010 |

* cited by examiner

*Primary Examiner* — Robert Beatty
(74) *Attorney, Agent, or Firm* — Smith, Gambrell & Russell, LLP

(57) ABSTRACT

An image forming apparatus includes: a development unit that develops an electrostatic latent image on an image bearing member and is demountable from a main body of the apparatus; a developer bearing member that is provided in the development unit and supplies a developer it bears to the image bearing member; a motor that drives the developer bearing member to rotate; and a control portion that allows the motor to rotate in a first rotation direction and in a second rotation direction reverse to the first rotation direction. During image formation, the control portion rotates the motor in the first rotation direction, and when a replacement mode is set in which the development unit is demounted from the apparatus main body so as to be replaced, the control portion rotates the motor in the second rotation direction so that the developer bearing member is rotated by a predetermined amount in a direction reverse to a direction in which the developer bearing member is rotated during the image formation.

7 Claims, 4 Drawing Sheets

IMAGE FORMING APPARATUS INCLUDING DEMOUNTABLE DEVELOPING UNIT

This application is based on Japanese Patent Application No. 2010-190128 filed on Aug. 26, 2010, the contents of which are hereby incorporated by reference.

BACKGROUND OF THE INVENTION

1. Field of the Invention

The present invention relates to an image forming apparatus such as a copy machine, a printer, a facsimile, or a complex machine having functions of these apparatuses, and particularly relates to an image forming apparatus allowing replacement of a development unit.

2. Description of Related Art

In an image forming apparatus such as a copy machine, a printer, a facsimile, or a complex machine having functions of these apparatuses, with progressing duration of use thereof, timely maintenance should be performed with respect to a drum unit including a photosensitive drum and a development unit including a development sleeve. For this reason, units requiring maintenance such as the drum unit and the development unit are so designed as to be individually removable from and insertable into a main body of the image forming apparatus.

For example, in an image forming apparatus in which four fan-shaped development units for respective colors of cyan, magenta, yellow, and black are disposed annularly, each of the development units is so designed as to be movable by rotation to a development position opposed to a photosensitive member. Each of the development units includes a development roller and a cover member movable between a position at which the cover member covers the development roller and a position at which the cover member has the development roller exposed. The cover member is so configured as to be opened in response to the rotation of each of the development units before it reaches to the development position and closed again after development is completed. In forming an image, each of the development units is moved by rotation to the development position at which toner is supplied from the development roller thereof to the photosensitive member, and thus an electrostatic latent image on the photosensitive member is developed into a toner image. In a case where any one of the development units is to be replaced for the purpose of developer replenishment or a maintenance check, the development unit in question is moved by rotation to an upper position in a main body of the apparatus, and then a cover of the apparatus disposed at an upper portion of the apparatus main body is opened, through which the development unit in question is taken out to the outside of the apparatus main body and a new development unit is mounted thereinto. At this time, the cover member is in a closed state, thereby preventing an operator replacing the development unit in question from soiling his/her hands with a developer contained therein or from spilling the developer.

With regard to an image forming apparatus such as a complex machine or a high-performance multi-functional printer, it is conventionally a serviceperson who provides maintenance work such as replacing a development unit. It has recently been more common, however, that a development unit or the like is replaced by a user instead of a serviceperson. In a case where a user replaces a development unit, it is necessary that a procedure for replacing the development unit be easy to understand and that measures be taken against possible erroneous operations such as dropping the development unit during the replacement. The above-described image forming apparatus, however, has been disadvantageous in that the replacement procedure is complex and hard to understand and in that a developer contained in the development unit might be scattered to the outside thereof if the development unit is accidentally dropped.

SUMMARY OF THE INVENTION

It is an object of the present invention to provide an image forming apparatus that allows easy replacement of a development unit without causing scattering of a developer.

An image forming apparatus according to one aspect of the present invention includes: a development unit that develops an electrostatic latent image on an image bearing member and is demountable from a main body of the apparatus; a developer bearing member that is provided in the development unit and supplies a developer it bears to the image bearing member; a motor that drives the developer bearing member to rotate; and a control portion that allows the motor to rotate in a first rotation direction and in a second rotation direction reverse to the first rotation direction. During image formation, the control portion rotates the motor in the first rotation direction, and when a replacement mode is set in which the development unit is demounted from the apparatus main body so as to be replaced, the control portion rotates the motor in the second rotation direction so that the developer bearing member is rotated by a predetermined amount in a direction reverse to a direction in which the developer bearing member is rotated during the image formation.

Still other objects of the present invention and specific advantages provided by the present invention will be made further apparent from the following description of an embodiment.

DETAILED DESCRIPTION OF PREFERRED EMBODIMENTS

The following describes an embodiment of the present invention with reference to the appended drawings without limiting the present invention thereto. Furthermore, an intended use of the invention and terms and the like included in the following description are not to be construed as limiting.

Figure 1:
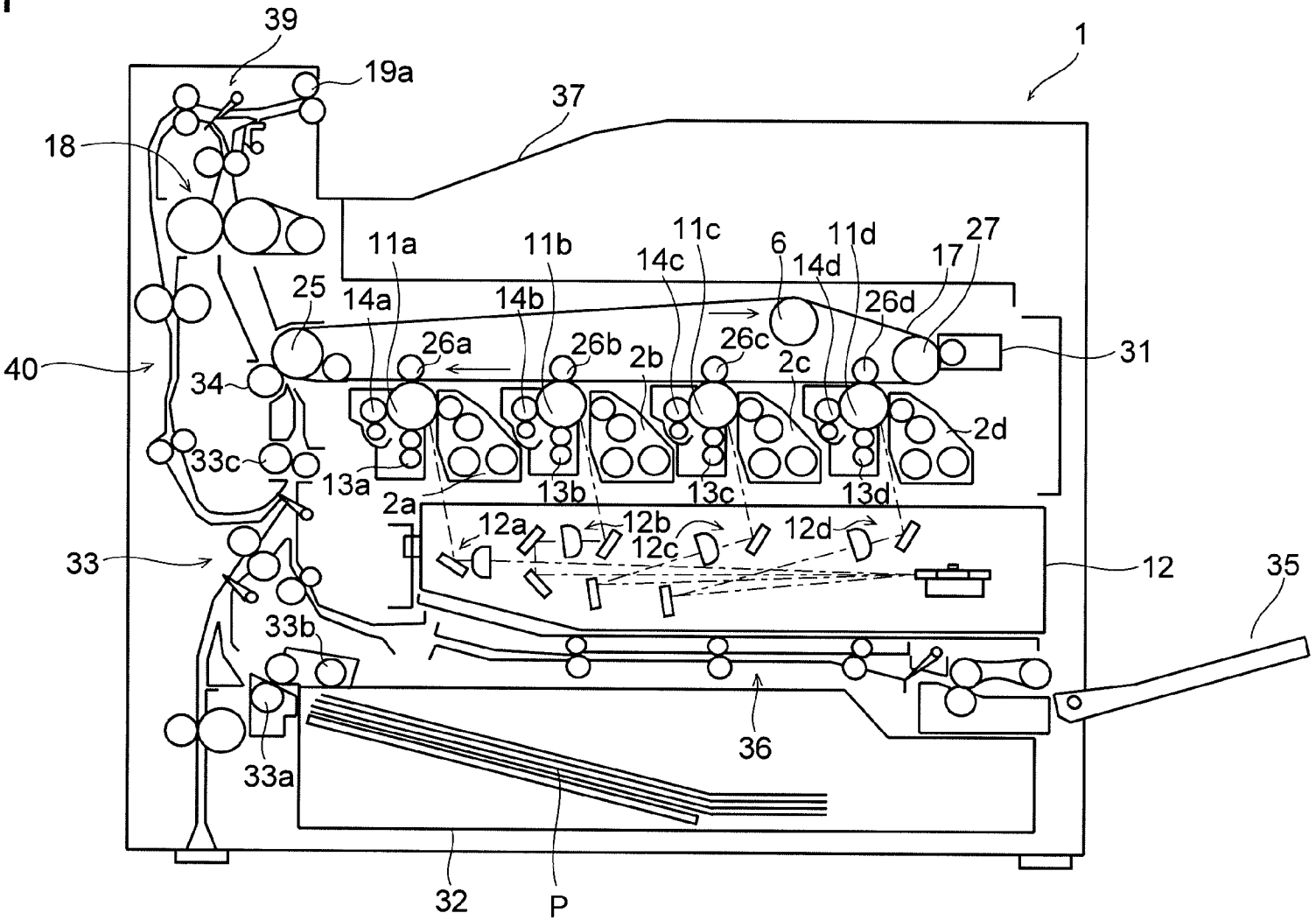
FIG. 1 is a diagram schematically showing an image forming apparatus according to an embodiment of the present invention.

FIG. 1 is a diagram schematically showing a configuration of an image forming apparatus including a development unit according to the embodiment of the present invention. An image forming apparatus 1 is a tandem type color printer, in which rotatable photosensitive members 11*a* to 11*d* using an organic photoreceptor (OPC photoreceptor) as a photosensitive material for forming a photosensitive layer are disposed correspondingly to respective colors of magenta, cyan, yellow, and black. Around each of the photosensitive members

11*a* to 11*d*, development units 2*a* to 2*d*, an exposure unit 12, chargers 13*a* to 13*d*, and cleaners 14*a* to 14*d* are disposed, respectively.

The development units 2*a* to 2*d* are disposed so as to be opposed respectively to the photosensitive members 11*a* to 11*d* on the right side thereof and supply toner to the photosensitive members 11*a* to 11*d*, respectively. The chargers 13*a* to 13*d* are disposed upstream of the development units 2*a* to 2*d* with respect to a rotation direction of the photosensitive members 11*a* to 11*d* so as to be opposed to the surfaces of the photosensitive members 11*a* to 11*d*, respectively, and uniformly charge the surfaces of the photosensitive members 11*a* to 11*d*, respectively.

The exposure unit is to scan each of the photosensitive members 11*a* to 11*d* for exposure based on image data such as characters and patterns inputted to an image input portion (omitted in the figure) from a personal computer or the like and is disposed below the development units 2*a* to 2*d*. In the exposure unit 12, a laser light source and a polygonal mirror are provided, and a reflection mirror and a lens are provided correspondingly to each of the photosensitive members 11*a* to 11*d*. Laser light emitted from the laser light source is irradiated onto each of the surfaces of the photosensitive members 11*a* to 11*d* via the polygonal mirror, the reflection mirror, and the lens, from downstream of the chargers 13*a* to 13*d* with respect to the rotation direction of the photosensitive members 11*a* to 11*d*, respectively. This irradiation laser light is used to form electrostatic latent images on the surfaces of the photosensitive members 11*a* to 11*d*, which are then developed into toner images by the development units 2*a* to 2*d*, respectively.

An endless intermediate transfer belt 17 is laid in a tensioned condition over a tension roller 6, a drive roller 25, and a driven roller 27. The drive roller 25 is driven to rotate by an unshown motor, and the intermediate transfer belt 17 is driven circularly by the rotation of the drive roller 25.

The photosensitive members 11*a* to 11*d* are arranged below the intermediate transfer belt 17 so as to be in contact therewith along a conveying direction (arrow direction in FIG. 1) adjacently to each other. Primary transfer rollers 26*a* to 26*d* are opposed to the photosensitive members 11*a* to 11*d*, respectively, via the intermediate transfer belt 17, and each of them comes into press-contact with the intermediate transfer belt 17 to form a primary transfer portion. At this primary transfer portion, in response to the rotation of the intermediate transfer belt 17, each of the toner images on the photosensitive members 11*a* to 11*d* is successively transferred onto the intermediate transfer belt 17 at predetermined timing. The toner images of the four colors of magenta, cyan, yellow, and black are thus superposed on one another to form a toner image on the surface of the intermediate transfer belt 17.

A secondary transfer roller 34 is opposed to the drive roller 25 via the intermediate transfer belt 17 and comes into press-contact with the intermediate transfer belt 17 to form a secondary transfer portion. At this secondary transfer portion, the toner image on the surface of the intermediate transfer belt 17 is transferred onto a paper sheet P. After the transfer, a belt cleaner 31 cleans off toner remaining on the intermediate transfer belt 17.

In a lower portion of the image forming apparatus 1, a paper sheet feed cassette 32 for storing the paper sheets P is disposed, and on the right side of the paper sheet feed cassette 32, a stack tray 35 for manually feeding paper sheets is disposed. On the left side of the paper sheet feed cassette 32, a first paper sheet conveying path 33 is provided along which the paper sheet P fed out from the paper sheet feed cassette 32 is conveyed to the secondary transfer portion on the intermediate transfer belt 17. Furthermore, on the left side of the stack tray 35, a second paper sheet conveying path 36 is provided along which a paper sheet fed out from the stack tray 35 is conveyed to the secondary transfer portion. Moreover, above the secondary transfer portion, a fixing portion 18 is disposed that performs fixing processing with respect to the paper sheet P on which the image has been formed, and a third paper sheet conveying path 39 is also provided along which the paper sheet P that has been subjected to the fixing processing is conveyed to a paper sheet ejection portion 37.

The paper sheet feed cassette 32 can be replenished with paper sheets when pulled out to the outside (front side of the paper plane of FIG. 1) of the apparatus, and the stored paper sheets P are fed out one after another to a first paper sheet conveying path 33 side by a pick-up roller 33*b* and a handling roller 33*a*.

The first paper sheet conveying path 33 and the second paper sheet conveying path 36 join together upstream of a resist roller 33*c* by which the paper sheet P is conveyed to the secondary transfer portion in synchronization with the timing of the image forming operation on the intermediate transfer belt 17 and the timing of the paper sheet feeding operation. Onto the paper sheet P conveyed to the secondary transfer portion, the toner image on the intermediate transfer belt 17 is secondarily transferred by the secondary transfer roller 34 to which a bias potential has been applied, and the paper sheet P is then conveyed to the fixing portion 18.

The fixing portion 18 includes a fixing belt that is heated by a heater, a fixing roller that internally comes into contact with the fixing belt, a pressure roller that is disposed so as to be in press-contact with the fixing roller via the fixing belt, and so on and performs fixing processing by applying heat and pressure to the paper sheet P on which the toner image has been transferred. The paper sheet P on which the toner image has thus been fixed by the fixing portion 18 is then turned over in a fourth paper sheet conveying path 40 if necessary so that a toner image is secondarily transferred onto a rear side of the paper sheet P as well by the secondary transfer roller 34, which is then fixed by the fixing portion 18. The paper sheet on which the toner image has been fixed is passed along the third paper sheet conveying path 39 and ejected to the paper sheet ejection portion 37 by an ejection roller 19*a*.

Figure 2:
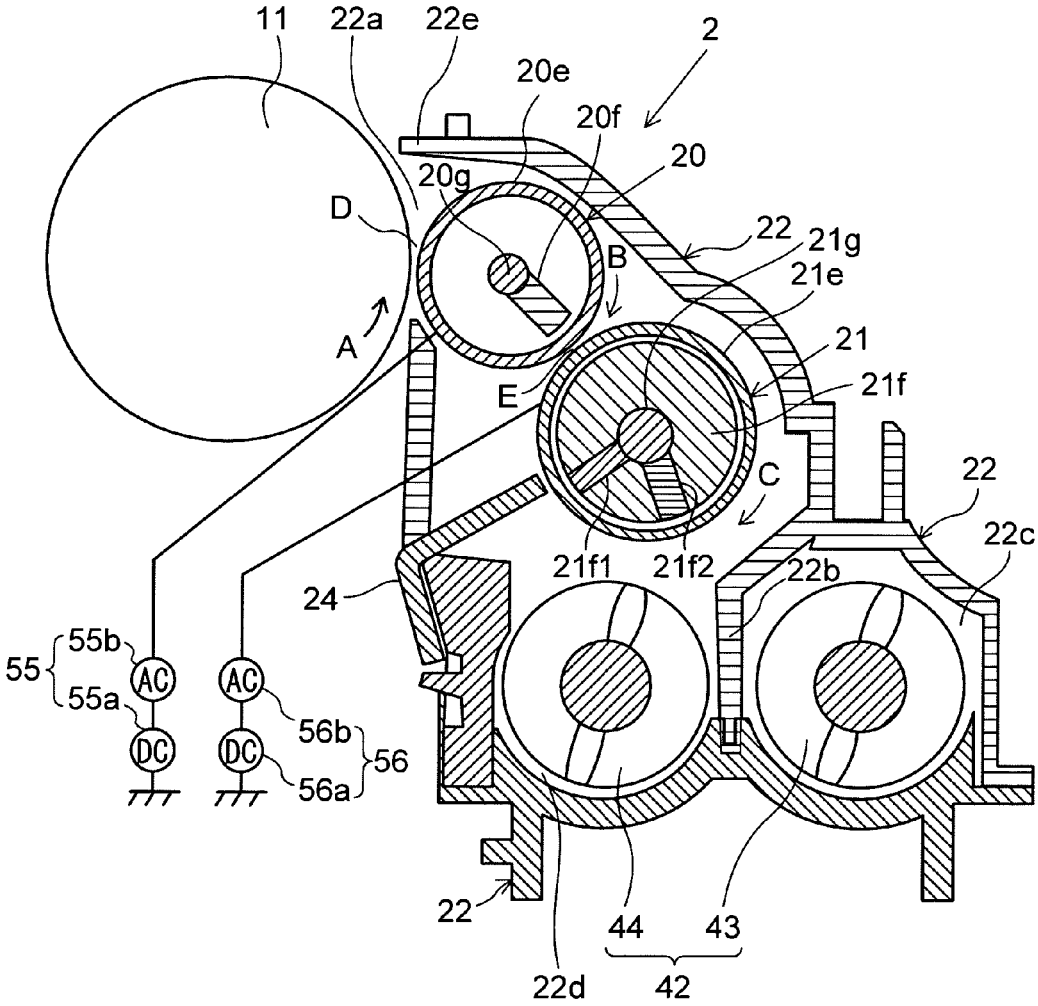
FIG. 2 is a cross-sectional view schematically showing a development unit included in the image forming apparatus according to the embodiment of the present invention.

FIG. 2 is a cross-sectional view showing a configuration of a development unit used in the above-described image forming apparatus 1. In the following, a configuration and an operation of the development unit 2*a* corresponding to the photosensitive member 11*a* shown in FIG. 1 are described, and as for configurations and operations of the development units 2*b* to 2*d*, since they are similar to those of the development unit 2*a*, descriptions thereof are omitted. Furthermore, in the following description, signs a to d for indicating the development units and the photosensitive members for the respective colors are omitted, which, however, may be used where necessary.

A development unit 2 is composed of a development roller 20, a magnetic roller 21 that is a developer bearing member, a stirring portion 42, a regulation member 24, a development container 22, and so on.

The development container 22 constitutes an outer frame of the development unit 2 and is partitioned at a lower portion thereof into a first conveying path 22*d* and a second conveying path 22*c* by a partition member 22*b*. In the first conveying path 22*d* and the second conveying path 22*c*, a developer made of a magnetic carrier and toner is stored. Furthermore, the development container 22 rotatably holds the stirring member 42, the magnetic roller 21, and the development roller 20. Moreover, the development container 22 has an opening 22*a* through which the development roller 20 is exposed toward a photosensitive member 11.

The stirring portion 42 is provided in a bottom portion of the development container 22 and composed of two members that are a first stirring member 44 and a second stirring member 43. The first stirring member 44 is provided in the first conveying path 22*d*, and on the right side thereof, the second stirring member 43 is provided in the second conveying path 22*c* adjacently to the first stirring member 44.

The first and second stirring members 44 and 43 stir the developer and charge the toner in the developer to a predetermined level. This causes the toner to be held by the magnetic carrier. Furthermore, on both end portion sides of the partition member 22*b* with respect to its longitudinal direction (front-to-rear direction of the paper plane of FIG. 2), which separates the first conveying path 22*d* and the second conveying path 22*c* from each other, communication portions (omitted in the figure) are provided, respectively, and when the second stirring member 43 is rotated, the charged developer is conveyed through one of the communication portions provided in the partition member 22*b* into the first conveying path 22*d* and thus circulates in the first conveying path 22*d* and in the second conveying path 22*c*. The developer is then supplied from the first stirring member 44 to the magnetic roller 21.

The magnetic roller 21 is disposed above the first stirring member 44 so as to be opposed thereto, bears and conveys the developer supplied from the first stirring member 44, and supplies only the toner to the development roller 20. The regulation member 24 is disposed so as to be opposed to the peripheral surface of the magnetic roller 21.

The regulation member 24 is made of a magnetic material such as stainless steel and has a plate shape, and on a diagonally lower left side of the magnetic roller 21, it is fixed to and held by the development container 22. A tip end portion of the regulation member 24 is opposed at a predetermined distance to the surface of the magnetic roller 21 and regulates the thickness of the developer borne on the surface of the magnetic roller 21.

Furthermore, the magnetic roller 21 includes a rotation sleeve 21*e* made of a non-magnetic material, a magnetic pole member 21*f*, and a roller shaft 21*g*.

The magnetic pole member 21*f* is made up of a plurality of magnets of different polarities provided at an outer peripheral portion and has a regulation pole 21*f*1 that is a north pole and provided at a position opposed to the regulation member 24 and a collection pole 21*f*2 that is a magnetic pole having the same polarity as that of the regulation pole 21*f*1 and provided adjacently to the regulation pole 21*f*1 in a circumferential direction. Furthermore, the magnetic pole member 21*f* is fixed by bonding or the like to the roller shaft 21*g*, and the roller shaft 21*g* is non-rotatably supported by the development container 22.

Having a magnetic force weaker compared with that of any other magnetic pole included in the magnetic pole member 21*f*, the collection pole 21*f*2 does not allow the developer to be borne on the surface of the magnetic roller 21 and collects a residue of the developer remaining without being used for the development into the stirring portion 42.

The rotation sleeve 21*e* is disposed around the magnetic pole member 21*f* at a predetermined distance therefrom, thereby allowing the developer to be borne on the surface of the rotation sleeve 21*e*. Furthermore, the rotation sleeve 21*e* is rotatably supported by the development container 22 and conveys the developer by being rotated in an arrow C direction by an unshown drive mechanism composed of a motor and a gear. Moreover, a bias 56 obtained by superimposing an alternating voltage 56*b* on a direct voltage 56*a* is applied to the rotation sleeve 21*e*.

On a diagonally upper left side of the magnetic roller 21, the development roller 20 is opposed at a given distance to the magnetic roller 21 and includes a development sleeve 20*e*, a magnetic pole member 20*f*, a stationary shaft 20*g*, and so on.

The development sleeve 20*e* is made of a non-magnetic material, has a cylindrical shape, and is rotatably supported by the development container 22. The magnetic pole member 20*f* is fixed by bonding or the like to the stationary shaft 20*g* at a position E opposed to the magnetic roller 21 so as to be at a predetermined distance from the development sleeve 20*e*. The stationary shaft 20*g* is non-rotatably supported by the development container 22. Furthermore, the development sleeve 20*e* is opposed to the photosensitive member 11 and disposed on the right side of the photosensitive member 11 at a given distance therefrom. The development sleeve 20*e* forms, at an opposed position at which it is opposed closely to the photosensitive member 11, a development region D at which it supplies the toner to the photosensitive member 11. The development sleeve 20*e* is rotated in an arrow B direction by an unshown drive mechanism composed of a motor and a gear. Furthermore, a development bias 55 obtained by superimposing an alternating voltage 55*b* on a direct voltage 55*a* is applied to the development sleeve 20*e*.

Hence, on the surface of the rotation sleeve 21*e* of the magnetic roller 21, the charged developer is borne while forming a magnetic brush under the magnetic force of the magnetic pole member 21*f*. This magnetic brush is adjusted so as to have a predetermined height by the regulation member 24 and the regulation pole 21*f*1. The magnetic brush having the predetermined height as a result of the adjustment is conveyed to the opposed position E by the rotation sleeve 21*e*. At the opposed position E, the magnetic brush is scooped up by the magnetic pole member 20*f* of the development roller 20, and when the magnetic brush comes into contact with the development sleeve 20*e*, only the toner included in the magnetic brush is supplied to the development sleeve 20*e* based on the bias 56 applied to the magnetic roller 21. As for a residue of the magnetic brush remaining without being supplied to the development sleeve 20*e*, as the rotation sleeve 21*e* is rotated, due to the collection pole 21*f*2, it becomes unable to be borne on the rotation sleeve 21*e* and is conveyed back to a first stirring member 44 side.

The toner borne on the development sleeve 20*e* is then conveyed to the development region D by the rotation of the development sleeve 20*e* in the arrow B direction. Upon application of the development bias 55 at the development region D, due to a potential difference between a development bias potential and a potential at an exposed portion on the photosensitive member 11, the toner borne on the development sleeve 20*e* flies to the photosensitive member 11. Particles of the flying toner successively adhere to the exposed portion on the photosensitive member 11 being rotated in an arrow A direction, so that an electrostatic latent image on the photosensitive member 11 is developed.

As discussed above, during image formation (printing mode), the magnetic roller 21 (rotation sleeve 21*e*) is rotated in the arrow C direction, and the development roller 20 (development sleeve 20*e*) is rotated in the arrow B direction. This embodiment includes a replacement mode in addition to the printing mode. The following describes the replacement mode with reference to FIGS. 3 and 4.

Figure 3:
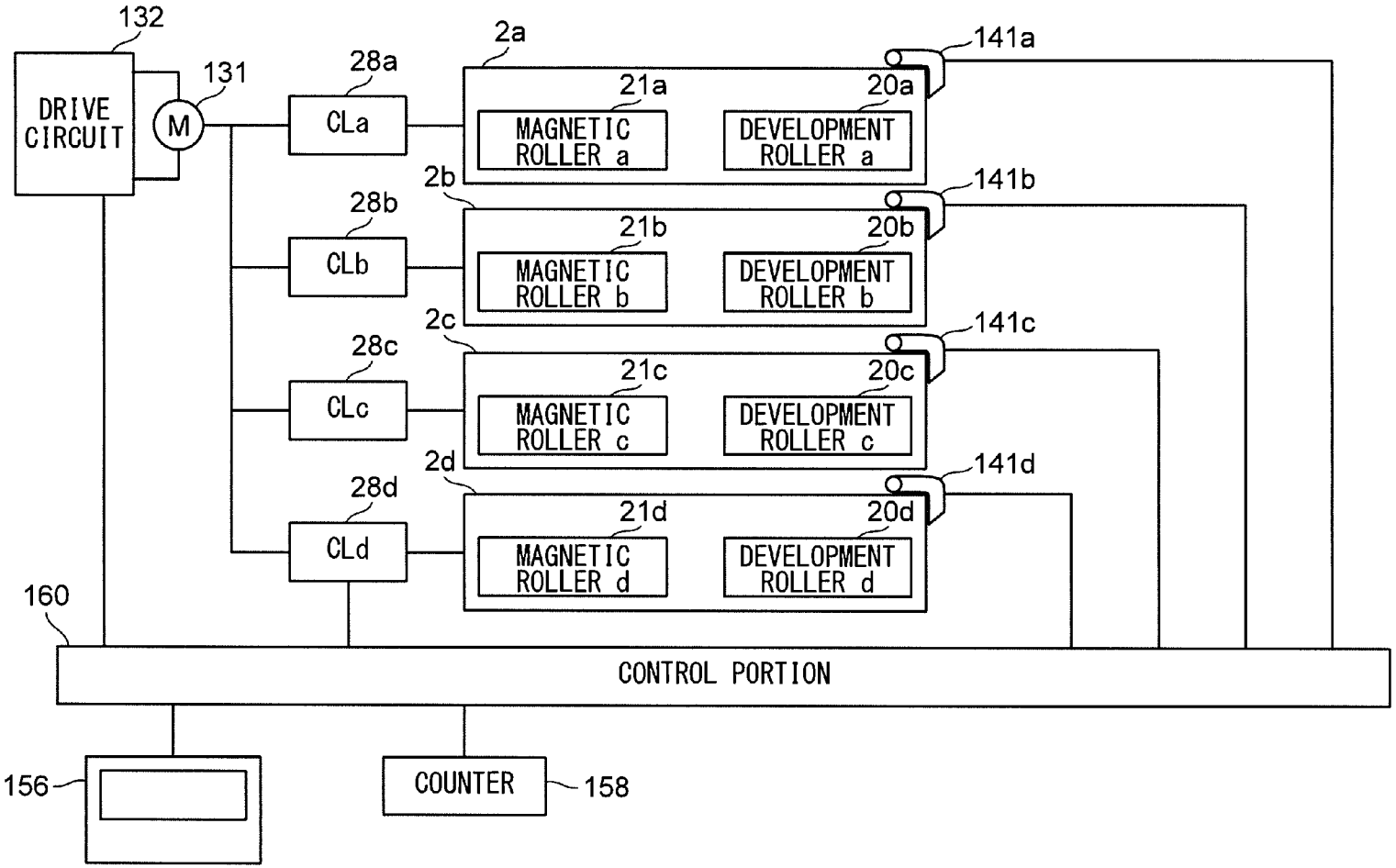
FIG. 3 is a block diagram showing a peripheral configuration of a control portion according to the embodiment of the present invention.
Figure 4:
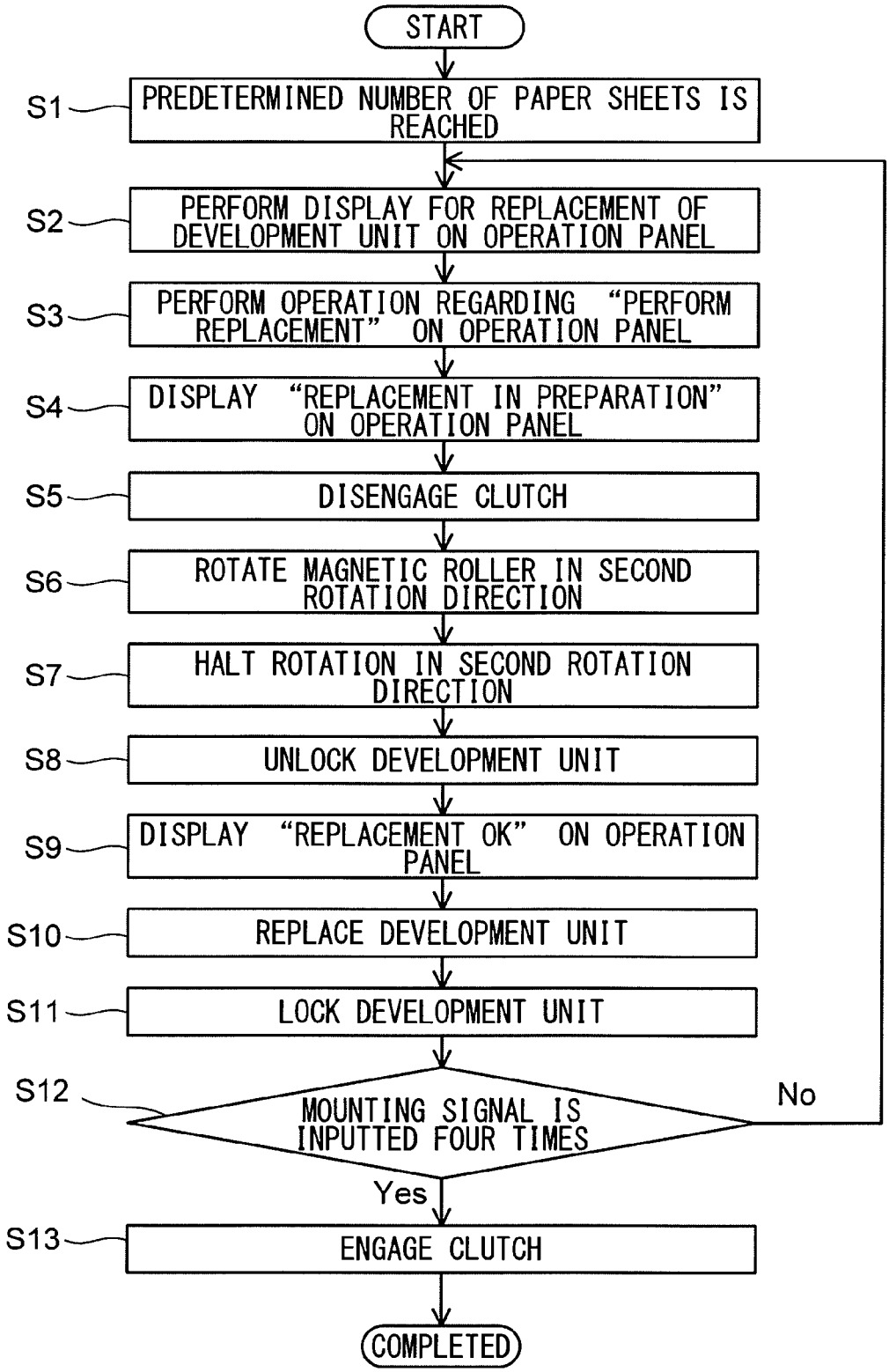
FIG. 4 is a flow chart illustrating a replacement mode according to the embodiment of the present invention.

FIG. 3 is a block diagram showing a peripheral configuration of a control portion that executes the replacement mode, and FIG. 4 is a flow chart illustrating the replacement mode.

The replacement mode is a mode in which, for example, the development unit 2 is checked for maintenance, replenished with a developer, or treated for clearance of a jam. In the replacement mode, the development unit 2 is demounted from a main body of the apparatus, and after predetermined processing is performed, the development unit 2 is mounted into the apparatus main body. Depending on the type of the predetermined processing, the development unit 2 as originally mounted may be mounted back into the apparatus main body or may be replaced with a new development unit 2.

As shown in FIG. 3, this embodiment includes the four development units 2*a* to 2*d* described earlier, four clutches 28*a* to 28*d* (may be referred to collectively as a clutch 28) that are provided correspondingly to the development units 2*a* to 2*d*, respectively, one motor 131, a drive circuit 132 that drives the motor 131, lock portions 141*a* to 141*d* (may be referred to collectively as a lock portion 141) that unlatchably latch the development units 2*a* to 2*d* to the apparatus main body, respectively, a counter portion 158 that counts the number of printed paper sheets, an operation panel 156, and a control portion 160.

The control portion 160 is composed of a microcomputer, storage elements that are a RAM and a ROM, and so on and, in accordance with programs and data stored in the storage elements, controls the drive circuit 132, display on the operation panel 156, the clutches 28*a* to 28*d*, and the lock portions 141*a* to 141*d* based on data as to the number of printed paper sheets inputted from the counter portion 158 and an input signal inputted from the operation panel 156.

The counter portion 158 counts every time development is performed by the development units 2*a* to 2*d* and performs summation thereof. Summation data thus obtained is inputted to the control portion 160. The storage elements such as the ROM in the control portion 160 store a numerical value corresponding to a predetermined number of printed paper sheets as a threshold requiring a maintenance check with respect to each of the development units 2*a* to 2*d*, and when the inputted summation data reaches the numerical value corresponding to the predetermined number of printed paper sheets, the control portion 160 switches from the printing mode to the replacement mode.

The motor 131 is formed of a DC motor and connected to the development units 2*a* to 2*d* via the clutches 28*a* to 28*d* that will be described later, respectively, so as to allow a driving force to be transmitted thereto by use of a gear or the like. When the motor 131 rotates in a first rotation direction, the magnetic rollers 21*a* to 21*d* are rotated in the arrow C direction (see FIG. 2), the development rollers 20*a* to 20*d* are rotated in the arrow B direction (see FIG. 2), and the stirring portion 42 is rotated in a predetermined direction (printing mode). On the other hand, in the replacement mode, the motor 131 rotates in a second rotation direction, and with the motor 131 rotating in the second rotation direction, the magnetic rollers 21*a* to 21*d* are rotated in a direction reverse to the arrow C direction (see FIG. 2), the development rollers 20*a* to 20*d* are rotated in a direction reverse to the arrow B direction (see FIG. 2), and the stirring portion 42 is rotated in a direction reverse to the predetermined direction.

The drive circuit 132 is formed of a bridge circuit that applies a pulse voltage to the motor 131 and thus drives the motor 131 to rotate by applying a pulse voltage thereto. The drive circuit 132 further switches a rotation direction of the motor 131 by operating a switch in the bridge circuit. The control portion 160 transmits a first direction signal or a second direction signal to the drive circuit 132 that then drives the motor 131 to rotate in the first rotation direction based on the first rotation signal or in the second rotation direction based on the second direction signal. Switching between the first and second direction signals is performed depending on whether the printing mode or the replacement mode is set. Switching to the first or second rotation direction may be performed also by using, as the motor 131, a stepping motor instead of a DC motor.

In a driving force transmission path between the motor 131 and the development units 2*a* to 2*d*, the clutches 28*a* to 28*d* are provided correspondingly to the development units 2*a* to 2*d* and enable/disable transmission of a driving force from the motor 131 to the development units 2*a* to 2*d*, respectively. Furthermore, each of the clutches 28*a* to 28*d* is formed of an electromagnetic clutch, and, when energization with respect to the clutches 28*a* to 28*d* is cut off, a spring in the electromagnetic clutch winds around a shaft therein and thus enables transmission of a driving force from the motor 131 to each of the development units 2*a* to 2*d*. On the other hand, when the clutches 28*a* to 28*d* are energized, the spring wound around the shaft is unwound and thus disables transmission of a driving force from the motor 131 to each of the development units 2*a* to 2*d*. As each of the clutches 28*a* to 28*d*, instead of such an electromagnetic clutch having a spring, an electromagnetic clutch that establishes connection by using a frictional force, an electromagnetic clutch that establishes connection through mesh engagement, or the like may also be used.

Energization with respect to the clutches 28*a* to 28*d* is controlled by the control portion 160 (in FIG. 3, a line is drawn to show that the control portion 160 controls the clutch 28*d*, while lines to show that the control portion 160 controls the clutches 28*a* to 28*c* are omitted). Specifically, in the printing mode, energization with respect to all the clutches 28*a* to 28*d* is cut off, and thus transmission of a driving force from the motor 131 to each of the development units 2*a* to 2*d* is enabled. On the other hand, in the replacement mode, energization with respect to one clutch 28 among the clutches 28*a* to 28*d* is cut off, while the three other clutches 28 are being energized. Thus, in the replacement mode, transmission of a driving force to one of the development units 2 corresponding to the one clutch 28 is enabled, while transmission of a driving force to each of the other development units 2 corresponding to the three other clutches 28, respectively, is disabled. The clutches 28*a* to 28*d* are successively energized in this manner, as a result of which transmission of a driving force to the development units 2*a* to 2*d* is successively enabled. The clutches 28*a* to 28*d* are successively switched between an energized state and a non-energized state in this manner, as a result of which the development units 2*a* to 2*d* can be successively brought to a replaceable state.

The lock portions 141*a* to 141*d* unlatchably latch the development units 2*a* to 2*d* to the apparatus main body, respectively, and each of the lock portions 141*a* to 141*d* has a latch pawl rotatable around a support shaft and a solenoid that moves the latch pawl between a latch position and an unlatch position. When the solenoid is in a non-energized state, the latch pawl is in the latch position and one of the development units 2 corresponding thereto is in a state of being latched to the apparatus main body, while when the solenoid is in an energized state, the latch pawl is in the unlatch position and the corresponding one of the development units 2 is in a state of being unlatched from the apparatus main body.

The lock portions 141*a* to 141*d* are controlled by the control portion 160 in conjunction with energization with respect to the clutches 28*a* to 28*d*. Specifically, in the printing mode, the solenoids of all the lock portions 141*a* to 141*d* are in the non-energized state and the development units 2*a* to 2*d* are in the state of being latched to the apparatus main body. On the other hand, in the replacement mode, among the solenoids of the lock portions 141*a* to 141*d*, one belonging to one of the lock portions 141 that latches/unlatches one of the development units 2 corresponding to one of the clutches 28, with respect to which energization is cut off, is energized, and the three other solenoids are in the non-energized state. Thus, in the replacement mode, one of the development units 2 corresponding to one lock portion 141 is unlatched and thus can be demounted from the apparatus main body. The other development units 2 corresponding to the three other lock portions 141, respectively, are in a latched state. The lock portions 141*a* to 141*d* are successively energized in this manner, as a result of which the development units 2*a* to 2*d* are successively unlatched from the apparatus main body.

The operation panel 156 has a display portion formed of a liquid crystal element and a touch panel type operation portion that allows an input operation by pressing or a touch with a finger on a display screen. Based on a command from the control portion 160, in the display portion of the operation panel 156, display regarding the printing mode, display regarding the replacement mode, and display prompting an operation through the operation portion are performed. In the operation portion of the operation panel 156, for example, instructions to replace the development units 2*a* to 2*d* are issued, which are then inputted to the control portion 160.

In accordance with the procedure shown in FIG. 4, the control portion 160 controls the motor 131, the clutches 28*a* to 28*d*, the lock portions 141*a* to 141*d*, and the operation panel 156. The following describes in detail a method of controlling them with reference to FIGS. 2 and 3 in addition to FIG. 4.

As shown in FIG. 4, at step 1, if the number of printed paper sheets reaches a predetermined number as a threshold requiring a maintenance check with respect to any one of the development units 2*a* to 2*d*, the control portion 160 switches from the printing mode to the replacement mode. In the replacement mode, jobs of step 2 and subsequent steps are performed. In the printing mode, the clutches 28*a* to 28*d* are engaged, thereby enabling transmission of a driving force from the motor 131 to each of the development units 2*a* to 2*d*, and the lock portions 141*a* to 141*d* are latching the development units 2*a* to 2*d* to the apparatus main body, respectively. Furthermore, in the printing mode, the first direction signal is transmitted to the drive circuit 132, and based on the first direction signal, the drive circuit 132 rotates the motor 131 in the first rotation direction. Driving the motor 131 to rotate in the first direction causes the magnetic rollers 21*a* to 21*d* to rotate in the arrow C direction (see FIG. 2) and the development rollers 20*a* to 20*d* to rotate in the arrow B direction (see FIG. 2), and thus image formation is performed.

At step 2, in the operation panel 156, display related to the replacement mode and display prompting replacement of the development units 2*a* to 2*d* are performed. In this embodiment, the four development units 2*a* to 2*d* are demounted in order from the apparatus main body for a maintenance check and mounted into the apparatus main body after the maintenance check. First, the development unit 2*d* disposed upstream in the paper sheet conveying direction is replaced in the following manner.

At step 3, in the operation panel 156, display prompting replacement of the development unit 2*d* is performed, and an operation of issuing an instruction to replace the development unit 2*d* is performed. For example, on the operation panel 156, "Perform replacement" is displayed in a blinking manner, and when a portion on the display screen, which is related to "Perform replacement", is operated by pressing or a touch, a replacement instruction signal indicative thereof is inputted to the control portion 160.

At step 4, "Replacement in preparation" is displayed on the operation panel 156 and continued to be displayed at steps 5 through 8. During this display period, a preparation is made to prevent any trouble from being caused by demounting of the development unit 2*d* from the apparatus main body.

At step 5, transmission of a driving force from the motor 131 to each of the development units 2*a* to 2*c* is disabled. That is, upon input of an input signal for instructing replacement at step 3, while the clutch 28*d* is set to be in the non-energized state so as to be in an engaged state, the clutches 28*a* to 28*c* are switched from the non-energized state to the energized state. This cancels the engaged state of the clutches 28*a* to 28*c* to disable transmission of a driving force from the motor 131 to each of the development units 2*a* to 2*c*, thereby allowing a driving force from the motor 131 to be transmitted only to the development unit 2*d*.

Normally, when rotated in the second rotation direction for collection of a residual developer on the magnetic roller 21, the motor 131 is placed under a larger load compared with a case where the motor 131 is rotated in the first rotation direction. According to the above-described configuration, however, in the image forming apparatus 1 having the plurality of the development units 2*a* to 2*d*, in the replacement mode, the clutches 28*a* to 28*d* are engaged or disengaged so that only the development unit 2*d* is rotated. This reduces a load applied to the motor 131, eliminates the need to use a particular motor, allows a motor used in the printing mode to be used also in the replacement mode, achieves a size reduction of a drive source having a motor and so on, and prevents a cost increase.

Next, at step 6, the motor 131 is rotated in the second rotation direction so that the magnetic roller 21*d* is reversely rotated for collection of a developer on the magnetic roller 21*d*. Reversely rotating the magnetic roller 21 causes the residual developer on the magnetic roller 21 to be collected inside the development unit 2, for example, in a portion thereof on a stirring portion 42 side. Hence, even in a case where the development unit 2 is demounted from the apparatus main body, since a developer is stored inside the development unit 2, the developer is prevented from being exposed from the development unit 2, and thus even if the development unit 2 is accidentally dropped, scattering of the developer from the development unit 2 can be prevented.

Specifically, instead of the first direction signal, the second direction signal is inputted to the drive circuit 132. Based on the second direction signal, the motor 131 is driven to rotate in the second rotation direction, in response to which the magnetic roller 21*d* is rotated in the direction reverse to the arrow C direction (see FIG. 2), the development roller 20*d* is rotated in the direction reverse to the arrow B direction (see FIG. 2), and the stirring portion 42 is rotated in the direction reverse to the predetermined direction. At this time, on the magnetic roller 21*d*, a residue of a developer remains after development. When the magnetic roller 21*d* is rotated one turn in the direction reverse to the arrow C direction, however, the residue of the developer remaining on the magnetic roller 21*d* around its entire circumference is conveyed toward the collection pole 21*f*2 (see FIG. 2), and at a position opposed to the collection pole 21*f*2, it becomes unable to be borne on the magnetic roller 21*d* and is collected into the stirring portion 42. With the magnetic roller 21 rotated at least one turn in the reverse direction, even in a case where a residue of a developer remains on the magnetic roller 21 around its entire circumference after the completion of development, the residue of the developer can be collected inside the development unit 2.

After the magnetic roller 21*d* is rotated one turn, at step 7, a halt signal is transmitted to the drive circuit 132 and thus halts the rotation of the motor 131.

Next, at step 8, the lock portion 141*d* latching the development unit 2*d* to the apparatus main body is released from that state. That is, an energization signal for energizing the solenoid is transmitted to the lock portion 141*d* and thus energizes the solenoid of the lock portion 141*d*, so that the latch pawl of the lock portion 141*d* is moved from the latch position to the unlatch position. Thus, the development unit 2*d* latched by the lock portion 141*d* is unlatched and thus can be demounted from the apparatus main body.

As described above, the development unit 2 cannot be demounted from the apparatus main body until the motor 131 has rotated by a predetermined amount in the second rotation direction. Hence, the development unit 2 is demounted from the apparatus main body after a residual developer on the magnetic roller 21 has been collected inside the development unit 2, and thus scattering of a developer from the development unit 2 can be reliably prevented.

Completing this unlocking job means that a preparation for demounting the development unit 2*d* from the apparatus main body is completed, and therefore, at step 9, "Replacement OK" is displayed on the operation panel 156, thus prompting a user to demount the development unit 2*d* from the apparatus main body. In order for this to be more strongly prompted, the display may be performed in a blinking manner, or a message easier to understand such as "Please demount development unit 2*d* from apparatus main body" may be displayed instead.

According to this configuration, replacement of the development units 2*a* to 2*d* is performed based on the procedure displayed on the operation panel 156, and thus the replacement operation can be performed easily and reliably.

At step 10, the user demounts the development unit 2*d* from the apparatus main body, performs a maintenance check with respect to the development unit 2*d*, mounts the demounted development unit 2*d* into the apparatus main body if no defect is found, and mounts a new development unit 2*d* into the apparatus main body if any defect is found. At the time the development unit 2*d* is mounted into the apparatus main body, a mounting signal is inputted to the control portion 160 through, for example, electrical pressing on a switch piece. The control portion 160 counts the number of times the mounting signal is inputted.

Upon the input of the mounting signal, at step 11, a non-energization signal for bringing the solenoid to the non-energized state is transmitted to the lock portion 141*d* and thus brings the solenoid of the lock portion 141*d* to the non-energized state, so that the latch pawl of the lock portion 141*d* is moved from the unlatch position to the latch position. Thus, the development unit 2*d* is latched to the apparatus main body.

Next, at step 12, it is determined whether or not the number of times the mounting signal related to the development unit 2 is inputted has reached four. If the number of times the mounting signal is inputted has not reached four yet, a return is made to step 2 where display prompting replacement of the development unit 2*c* is performed next, after which with respect to the development unit 2*c*, the jobs of steps 3 to 12 are performed. Similarly, with respect to each of the development units 2*b* and 2*a*, the jobs of steps 2 to 12 are performed. Then, when the number of times the mounting signal is inputted reaches four, a job of step 13 is performed.

At step 13, all the clutches 28*a* to 28*d* are bought to the non-energized state. This brings the clutches 28*a* to 28*d* to the engaged state to enable transmission of a driving force from the motor 131 to each of the development units 2*a* to 2*d*, and the replacement mode thus is completed and switched to the printing mode.

The above-described embodiment shows a configuration in which, at step 1 in the flow chart shown in FIG. 4, if the predetermined number of printed paper sheets is reached, switching from the printing mode to the replacement mode is performed. The present invention, however, is not limited thereto and may have a configuration in which switching from the printing mode to the replacement mode is performed based on a page coverage rate of a formed image. In this case, summation of a page coverage rate of an image is performed by summing up the rate since mounting of each of the development units 2*a* to 2*d*, and when the sum total of the page coverage rate reaches a predetermined value, switching from the printing mode to the replacement mode is performed.

Furthermore, the above-described embodiment shows an example in which the present invention is applied to a color image forming apparatus including a plurality of development units. The present invention, however, is not limited thereto and may be applied also to a monochrome image forming apparatus including one development unit. This case does not include step 12 in the flow chart shown in FIG. 4.

Furthermore, the above-described embodiment shows a configuration in which switching from the printing mode to the replacement mode is performed for the purpose of performing a maintenance check with respect to a development unit. The present invention, however, is not limited thereto and may have a configuration in which a development unit includes a development device having a development roller and so on and a cartridge for replenishing the development device with a developer, and switching from the printing mode to the replacement mode is performed for the purpose of developer replenishment when the developer in the cartridge is decreased by consumption to an amount not larger than a predetermined amount. This case also provides effects similar to those provided by the above-described embodiment.

Furthermore, the above-described embodiment shows an example in which the magnetic roller 21 is defined to be a developer bearing member. The present invention, however, is not limited thereto and may be applied also to the following configuration. That is, in a development unit in which a developer is borne on a development roller and only toner included in the developer borne on the development roller is supplied toward a photosensitive member, switching of a rotation direction of the development roller is performed.

What is claimed is:

1. An image forming apparatus, comprising:

a development unit that develops an electrostatic latent image on an image bearing member and is demountable from a main body of the apparatus;

a lock portion that unlatchably latches the development unit to the apparatus main body;

a developer bearing member that is provided in the development unit and bears a developer;

a motor that drives the developer bearing member to rotate; and a control portion that allows the motor to rotate in a first rotation direction and in a second rotation direction reverse to the first rotation direction, wherein during image formation, the control portion rotates the motor in the first rotation direction, and during when a replacement mode is set in which the development unit is demounted from the apparatus main body so as to be replaced, the control portion rotates the motor in the second rotation direction so that the developer bearing member is rotated by a predetermined amount in a direction reverse to a direction in which the developer bearing member is rotated during the image formation, and performs control so that, in the replacement mode, latching by the lock portion is canceled after the motor is rotated by a predetermined amount in the second rotation direction.

2. The image forming apparatus according to claim 1, wherein the control portion controls the motor so that, in the replacement mode, the developer bearing member is rotated at least one turn.

3. The image forming apparatus according to claim 1, wherein a plurality of the development units are provided, and a plurality of clutches are further provided that enable/disable transmission of a driving force from the motor to each of the developer bearing members included in the development units, respectively, and in the replacement mode, the control portion rotates the motor in the second rotation direction in a state where one of the clutches is set to be in an engaged state and the other clutches to be in a disengaged state.

4. The image forming apparatus according to claim 3, wherein upon mounting of one of the development units into the apparatus main body, the control portion successively switches the clutches between the engaged state and the disengaged state.

5. The image forming apparatus according to claim 1, wherein a display portion is further provided that can perform display regarding the replacement mode, and the control portion operates the display portion so that the display portion displays a replacement operation procedure to be performed in the replacement mode.

6. The image forming apparatus according to claim 1, wherein when a predetermined number of printed paper sheets is reached, the control portion sets the replacement mode.

7. The image forming apparatus according to claim 1, wherein the development unit comprises:

a development roller that supplies a developer to the image bearing member; and a magnetic roller that bears a developer and supplies the developer to the development roller, and in the replacement mode, the magnetic roller is rotated by a predetermined amount in a direction reverse to a direction in which the magnetic roller is rotated during the image formation.

* * * * *